US006626751B1

(12) United States Patent
Umeda

(10) Patent No.: US 6,626,751 B1
(45) Date of Patent: Sep. 30, 2003

(54) COMPACT DUAL POWER TRANSMISSION MECHANISM FOR A COIN HOPPER

(75) Inventor: Masayoshi Umeda, Iwatsuki (JP)

(73) Assignee: Asahi Seiko Co., LTD, Tokyo (JP)

( * ) Notice: Subject to any disclaimer, the term of this patent is extended or adjusted under 35 U.S.C. 154(b) by 111 days.

(21) Appl. No.: 09/703,080

(22) Filed: Oct. 31, 2000

(30) Foreign Application Priority Data

Nov. 1, 1999 (JP) ..... 11-347957

(51) Int. Cl.[7] ..... G07D 1/00
(52) U.S. Cl. ..... 453/57; 74/810.1
(58) Field of Search ..... 453/57, 18, 63, 453/49, 51, 53, 54; 192/3.51, 3.55; 476/15, 25, 67; 74/640, 664, 665 R, 665 A, 810.1

(56) References Cited

U.S. PATENT DOCUMENTS 4,137,789 A * 2/1979 Herleth ..... 74/404
4,752,274 A * 6/1988 Abe ..... 453/32
4,760,751 A * 8/1988 Kasamatsu ..... 242/356
4,812,065 A * 3/1989 Shimogawara et al. ..... 400/624
5,499,777 A * 3/1996 Ahn ..... 242/356
5,984,771 A 11/1999 Abe

FOREIGN PATENT DOCUMENTS

GB 2016645 A * 9/1979 ..... F16H/1/02
JP 58-200845 A * 11/1983 ..... F16H/15/46

* cited by examiner

*Primary Examiner*—Donald P. Walsh
*Assistant Examiner*—Mark J Beauchaine

(57) ABSTRACT

The present invention provides a compact transmission assembly for use in a coin storage and dispensing apparatus. The transmission assembly can connect the rotational output of a reversible electrical motor to a link unit that supports a switching gear unit. A helical gear unit can be mounted adjacent to the link unit and can be driven axially along a shaft to contact a mounting unit to receive a thrust force and to drive the link unit in a clockwise or counter-clockwise direction depending upon the rotation of the reversible motor. The switching gear unit is radially mounted at an offset position on the link unit and can appropriately contact output gears connected to output shafts for providing a selective dual power output.

25 Claims, 10 Drawing Sheets

COMPACT DUAL POWER TRANSMISSION MECHANISM FOR A COIN HOPPER

BACKGROUND OF THE INVENTION

1. Field of the Invention

The present invention is directed to an improved compact transmission mechanism for driving a pair of output shafts by a reversible motor in a coin dispensing apparatus and more particularly to a simplified and economical switching gear mechanism that automatically responds to the output of a reversible electric motor.

2. Description of the Related Art

The present invention is directed to improvements in vending machine equipment wherein maintenance and costs are important factors. Vending machine equipment has been required to become more compact while still being required to handle the dispensing of coins and tokens for change or jackpots in gaming machines.

Generally, a coin hopper has components driven by a motor through a gear transmission system so that the motor can rotate in a clockwise direction and a counter-clockwise direction. Coin hopper equipment is usually driven to output coins from a bulk hopper. In a large capacity hopper equipment that is suitable, for example, in gambling and gaming machines, a large number of medallions or coins are stored and dispensed. As used in this application, the terminology "coin" includes not only coins of a monetary currency, but also can include medallions, disc-like medals, tokens, etc.

An example of a large capacity coin hopper can be found in the laid open Japanese Patent Application No. 11-251, 652. Referring to FIG. 9, a perspective view of the hopper equipment is disclosed. A cross-sectional view of the motor drive transmission assembly is shown in FIG. 9. A rectangular support or baseboard 4 extends in a vertical installation position and is supported by a pair of support frames 3. On one surface of the baseboard 4, a primary tank 1 for coin storage having a cylindrical shape is disclosed. Attached to this primary tank 1 is a larger capacity slanted or angled barrel case 10 with a secondary tank of a large pot like configuration having an opening 5 for receiving bulk coins. As can be readily determined, the primary tank 1, the intermediate case member 10 and the secondary tank 2 can store a large number of coins in bulk quantity. Within the primary tank 1, a deep plate-like dispensing disc 50 as shown in FIG. 10 is capable of contacting and releasing coins in a controlled manner. The deep plate-like disc is mounted for free rotation.

Mounted within the intermediate case member 10 is a flexible belt 14 with teeth or projections 15 that can be utilized for elevating the coins from the secondary storage tank 2 and dropping the coins into the deep plate-like disc 50. Thus, rotation of the belt 14 can distribute the coins to the primary tank I and as is conventionally known, the disc 50 or other structure can interact with the coins and selectively dispense the coins one by one.

To provide the rotational movement, a gear case 41 is fixed on the back surface of the baseboard 4 as can be seen in FIG. 10. An electric motor 40 can be appended from the gear case 41 so that the electric motor 40 can drive a small pinion gear 44 which is fixed to a shaft of the electric motor 40. The cross-section view of this gear arrangement is seen in FIG. 10. The pinion gear 44 can in turn mesh with a larger gear 45. The gear 45 is freely mounted within bearings to rotate. An output gear 46 further meshes with the large gear 45 and is also mounted for free rotation. Attached to this output gear 46 is a primary clutch member 47 and a secondary clutch member 48. The primary clutch member 47 can rotate the primary output shaft 42 when the electric motor 40 is rotated in a first positive direction. In this rotation, the primary output shaft 42 is coupled to a disc 50 for sending out the coins in the primary tank 1. The secondary clutch member 48 rotates a secondary output shaft 43 when the electric motor 40 is driven in a reverse direction. The secondary output shaft 43 is in turn coupled to a belt 31, see FIG. 9, by an intervening driving of the pulley 38, the belt 37, the pulley 36 shown in FIG. 9, and the shaft 34. This belt 31, while not shown, is coupled to the belt 14 for driving the coins in the case 10.

In summary, the disc 50, for picking up and sending the coins in a controlled manner, is rotated by the action of the primary clutch 47 when the electric motor 40 is rotated in a positive direction. At this time, the belt 14 for coin carrying is stopped by the action of the second clutch 48. When, however, the electric motor 40 is reversed, the second output shaft 43 is rotated by the action of the second clutch 48. As a result of this drive, the belt 31 is activated. During this activation, the disc 50 is not rotated by the action of the primary clutch 47. Thus, in this disclosure, either the disc 50 is rotated or the belt 14 is rotated in a selective manner, depending upon the direction of rotation of the electric motor 40.

As can be seen from FIG. 10, this arrangement requires a number of components and increases the size requirements of the coin dispenser. Additionally, since a pair of one-way clutches are utilized, there is always the possibility that inertia forces may jar and cause wear and vibration when the motor is reversed.

SUMMARY OF THE INVENTION

The present invention was developed in order to simplify transmission switching gear arrangement for dealing with a reversible motor. The present invention was also designed to decrease the number of parts and to simplify the transmission switching gear equipment. Additionally, the present invention was designed to absorb any reaction forces by a sudden stopping or reversing of the motor. The present invention was also designed to provide a relatively uncomplicated activation of one of two output shafts that can be automatically determined by a positive-reverse switching cycle relating to the direction of rotation of the motor.

The present invention provides a transmission assembly in a coin handling apparatus that can automatically activate one of two output shafts. A primarily stepped gear, which is freely mounted on a fixed shaft, includes a helical gear meshing with an output pinion of an electric motor. A spur gear is coaxially mounted on the shaft. A link unit comprising a pair of elongated movable boards or link members sandwich the primary step gear and are rotatable about the fixed shaft. Radially outward from the fixed shaft is a transfer shaft that extends between the respective link members and a second step gear is freely rotatably mounted on the transfer shaft and includes a switching gear that meshes with a coaxial spur gear. The spur gear can mesh with respective output shaft gears to respectively drive the desired output shafts. Positioned between the movable boards or link members and the primary step gear are elastic members such as spring like ring members to provide a frictional force between the primary step gear and the respective link members. Depending upon the rotation of the output shaft of the electric motor, the pinion gear will drive the helical gear to move upward or downward axially relative to the fixed shaft 23. When driven upward, it will cause a frictional engagement through an elastic spring member to drive the upper link member to rotate in a specific direction, thereby bringing the switching gear into engagement with a gear train to drive one of the output shafts. Conversely, a reverse driving of the pinion gear will drive the helical gear shaft downward to engage the lower elastic spring member to frictionally move the lower link member and rotate the large switching gear in the other direction to engage a transmission gear assembly to drive the other output shaft. As can be appreciated, the spring mounting can absorb some of the thrust forces that can occur upon a reversing of the electric motor.

As can be further determined, the number of parts and components utilized are substantially less than the conventional transmission mechanisms that have heretofore been used.

In summary, the present invention can be utilized in a coin storage and dispensing apparatus for storing coins in bulk wherein a reversible electrical motor can provide a driving force for transporting coins and also dispensing coins from a dispensing member. The present invention includes a transmission assembly of a compact configuration connected to the rotational output of the reversible electrical motor. A first supporting member or fixed shaft can rotatably mount a link unit. The link unit can include a first link member and a second link member that are rotatably mounted about the first support member. A first gear unit is mounted adjacent to the link unit and is operatively connected to the rotational output of the reversible motor. The first gear unit can be a stepped helical gear that can mesh with a helical pinion gear connected to an output shaft of the reversible electrical motor. A mounting unit is positioned to operatively contact the first gear unit and to rotate the link unit about the first support member depending upon the direction and rotation of the reversible electrical motor. The mounting unit can comprise a pair of spring plates or flexible bearing members that are mounted on either side of the first gear unit adjacent the first and second link members, respectively. The first gear unit can be driven to axially move along the support member and apply a thrust force to the mounting unit. Depending upon the direction of rotation of the reversible electrical motor, the link unit can rotate about the first support member in a clockwise or counter-clockwise direction. Radially offset from the first support member is a switching gear unit that can be mounted on a transfer support member extending between the first and second link members. The switching gear unit can be a stepped gear unit and it can be operatively connected to the first gear unit so that it provides a driving force at two separate positions about the first support member depending upon the direction of rotation of the reversible motor. The switching gear unit can include a spur gear that can intermesh with one of two output gears that are connected respectively to output shafts.

BRIEF DESCRIPTION OF THE DRAWINGS

The exact nature of this invention will be readily apparent from consideration of the following detailed description in conjunction with the accompanying drawings, wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a compact transmission of power that is automatically switchable to a coin dispenser.

Figure 1:
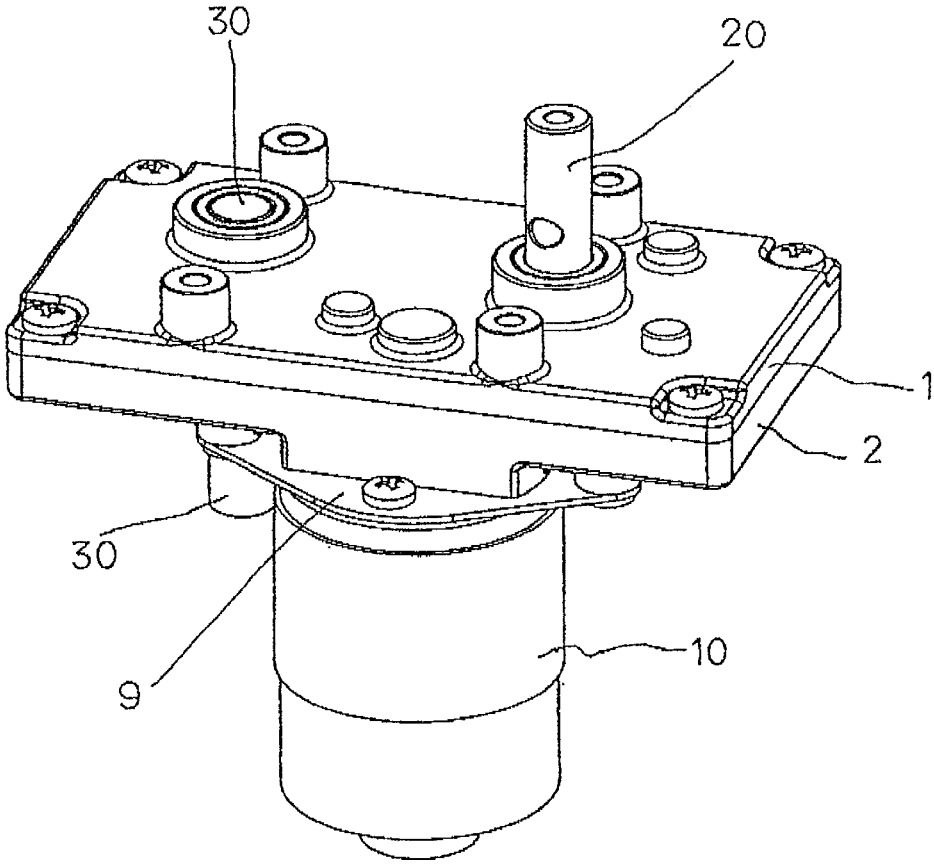
FIG. 1 is a perspective view of the electric motor and compact transmission mechanism for providing a pair of output shafts.
Figure 2:
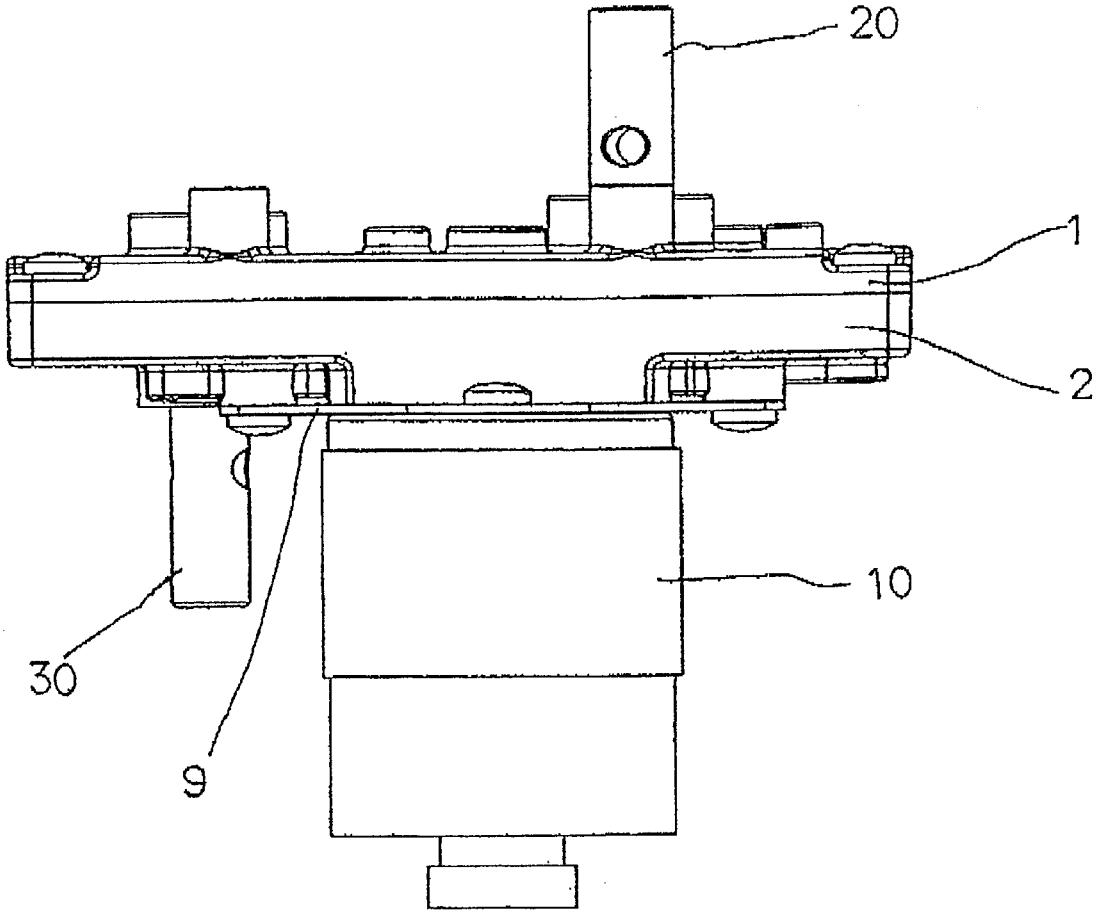
FIG. 2 is a side elevational view of FIG. 1 disclosing an output shaft on either side of the housing of the transmission mechanism.

The drawings disclosing the features of the present invention are illustrative only and not necessarily drawn to scale. Referring to FIG. 1, a perspective view of a compact gear box or transmission assembly including a housing that is split to have an upper casing member 1 and a lower casing member 2 is disclosed. The gear box, and more particularly the lower casing member 2 is mounted on a flange 9 attached to one end of the electric motor 10. As can be seen in FIG. 1, the transmission assembly is relatively compact and provides an upper output shaft 20 and a lower output shaft 30. The electric motor 10 that extends downward from the flange 9 can be of a direct current type and is reversible so that there is a positive rotation, for example, in a clockwise direction and a reverse rotation in a counter clockwise direction. As can be appreciated, as with a conventional hopper arrangement, the electric motor and transmission assembly can be appropriately mounted and suspended from the frame of a coin hopper for appropriately driving the coin hopper and components therein. Referring to FIG. 2, a side elevated view of the perspective view of FIG. 1 is disclosed.

Figure 3A:
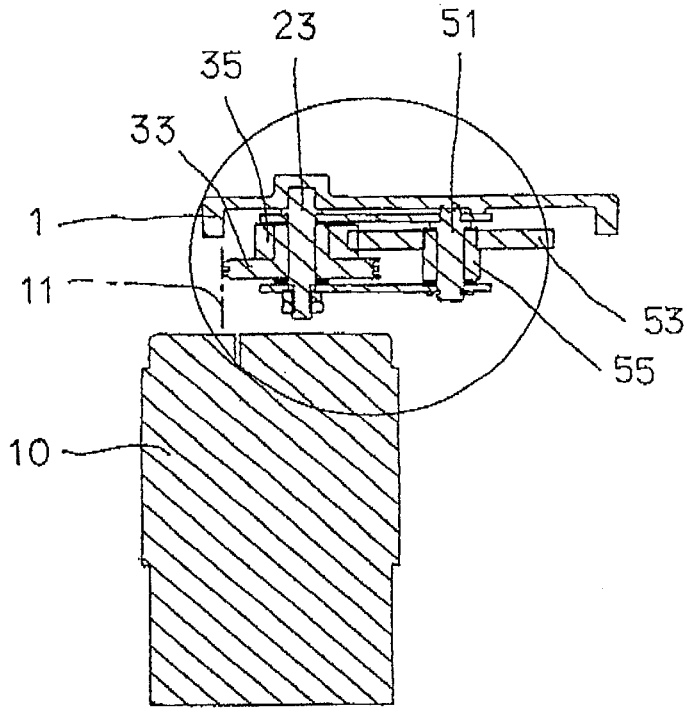
FIGS. 3*a* and 3*b* are partial cross-sectional views of a switching gear mechanism contained within the transmission assembly.
Figure 3B:
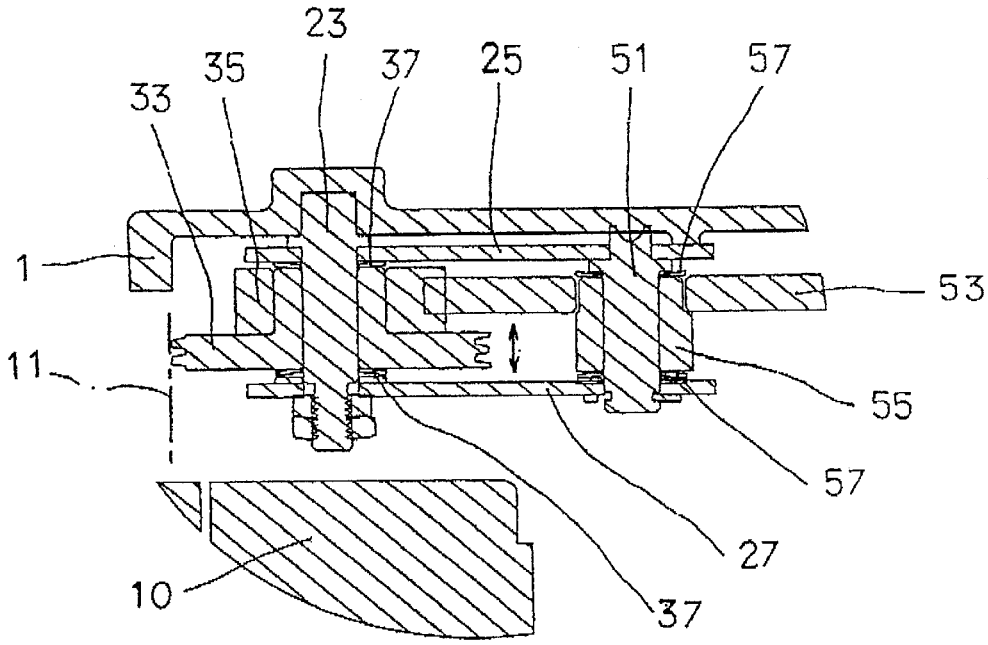
Figure 4A:
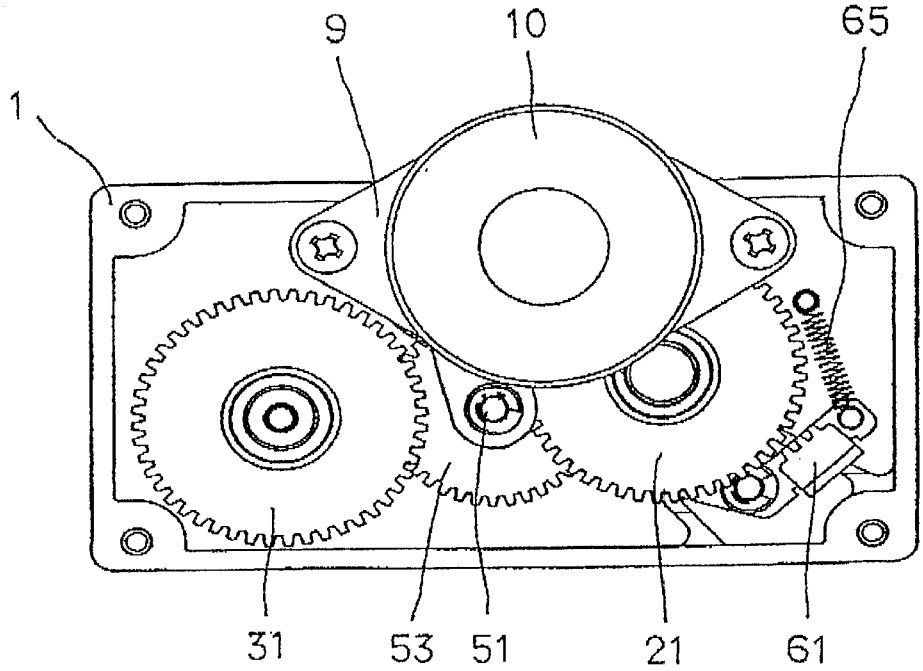
FIGS. 4*a* and 4*b* are respectively a schematic bottom view and a partial cross-sectional view of the transmission assembly.
Figure 4B:
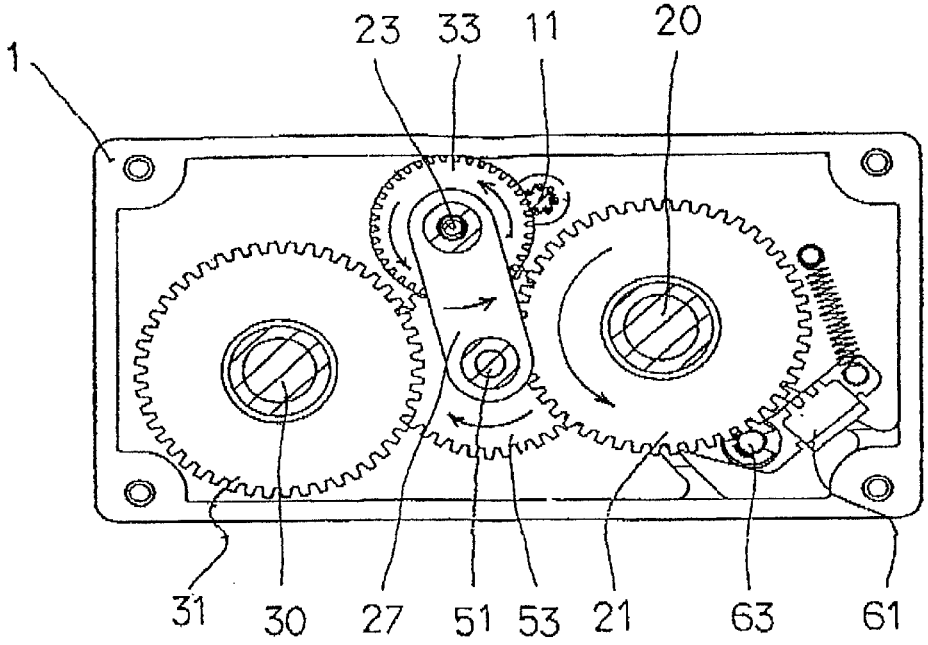

Referring to FIGS. 3*a* and 3*b*, the driving shaft of the electric motor 10 is connected to a small helical pinion gear 11 that is mounted between the upper case member 1 and the lower case member 2 within the gear box. See for example, FIGS. 5*a* and 5*b*. Referring again to FIG. 1, the cylindrical output shaft 20, which is shown at the right-hand portion of FIG. 1, is the primary output shaft of the gear transmission assembly. This primary output shaft 20 can rotate an internal disc (not shown) for selectively sending out coins in the hopper equipment. The disclosure of U.S. Pat. No. 5,984,771 is incorporated herein by reference to supplement the present disclosure. Fixed at the inner end of the primary output shaft 20 is a large output gear 21 as shown in FIG. 4. Also shown in FIG. 1 at the left-hand side is a second output shaft 30. This second output shaft 30 can drive a belt (not shown) for picking up and agitating coins within the hopper equipment so that coins could be translated from the open hopper through an intermediate casing member to the coin selecting disc. As shown in FIGS. 4*a* and 4*b*, a large output gear 31 is fixed to an inner end of the second output shaft 30 within the transmission casings 1 and 2.

Referring to FIGS. 3*a* and 3*b*, a switching gear mechanism is positioned within the transmission assembly between the primary output shaft 20 and the secondary output shaft 30.

The switching gear mechanism has a fixed shaft or first support member 23 that extends between the top and bottom case members 1 and 2. Freely rotated at either end of this fixed shaft member is a link unit comprising in one embodiment a pair of elongated movable board members or link members 25 and 27. Also journaled for free rotation about the fixed shaft 23 between the movable boards 25 and 27 is a large helical gear 33 that can move along the axial direction of the shaft 23. Additionally, a smaller spur gear 35 is coaxially mounted on the upper side of the gear 33 and with the gear 33 forms a primary stepped gear arrangement. A set of resilient bearing members such as plate springs 37, having a relatively strong elastic or spring force are positioned between respectively the movable board or link member 25 and the spur gear and helical gear 33 and act as switch members to form a mounting unit.

As also can be seen, the plate springs 37 are arranged between the lower movable board or link member 27 and the helical gear 33. Radially outward from the fixed shaft 23 is a transfer shaft 51 that is fixed adjacent to the end of each of the movable board members 25 and 27. Mounted about the transfer shaft 51 between the movable boards or link members 25 and 27 is a large switching gear 53 that can be freely rotated and is movable in the axial line of direction of the transfer shaft 51. This switching gear 53 further engages with a small spur gear 35 that is mounted on the fixed shaft 23. Thus, when the pinion gear 11 drives the helical gear 33, the spur gear 35 will drive the switching gear 53. In addition, a small spur gear 55 is formed at one side of the switching gear 53 so that the large switching gear 53 and the small spur gear 55 provide a second step gear arrangement. The plate springs 57 which are mounted between the lower movable board of link member 27 and the spur gear 55 have a relatively weak elastic or resilient force. Likewise, the upper plate spring 57 that is mounted between a flange on the transfer shaft 51 and the switching gear 53 or spur gear 55 also has a relatively weak elastic or resilient force.

Referring to FIGS. 5*a* and 5*b*, and FIGS. 7*a* and 7*b*, the relative rotation of the transfer gear 53 in a clockwise and counter-clockwise direction is disclosed.

Figure 6A:
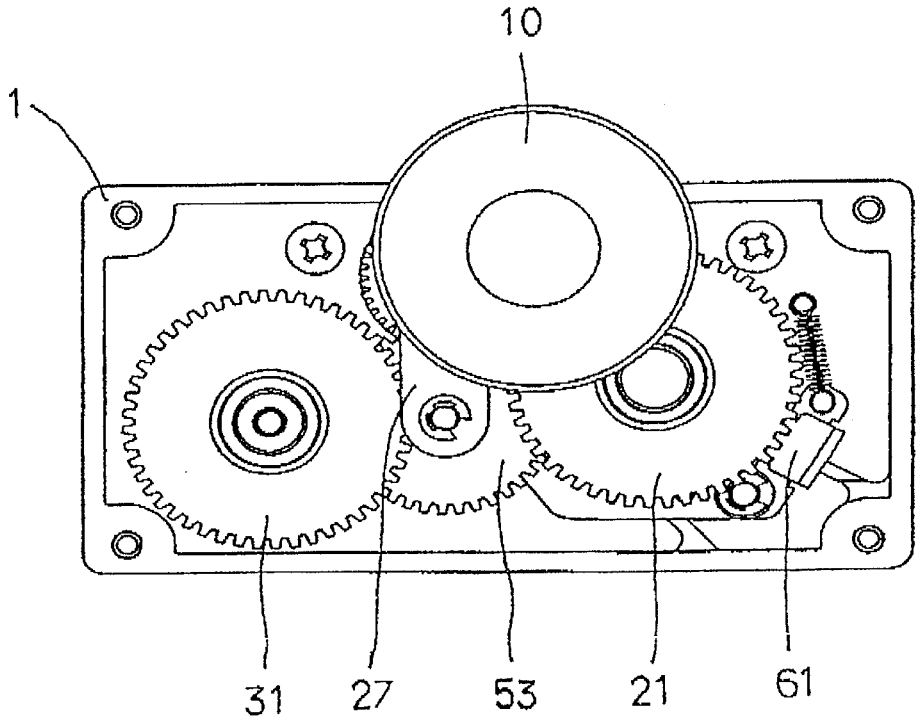
FIGS. 6*a* and 6*b* are respectively bottom views of FIG. 2 with certain elements removed for explanatory purposes.
Figure 6B:
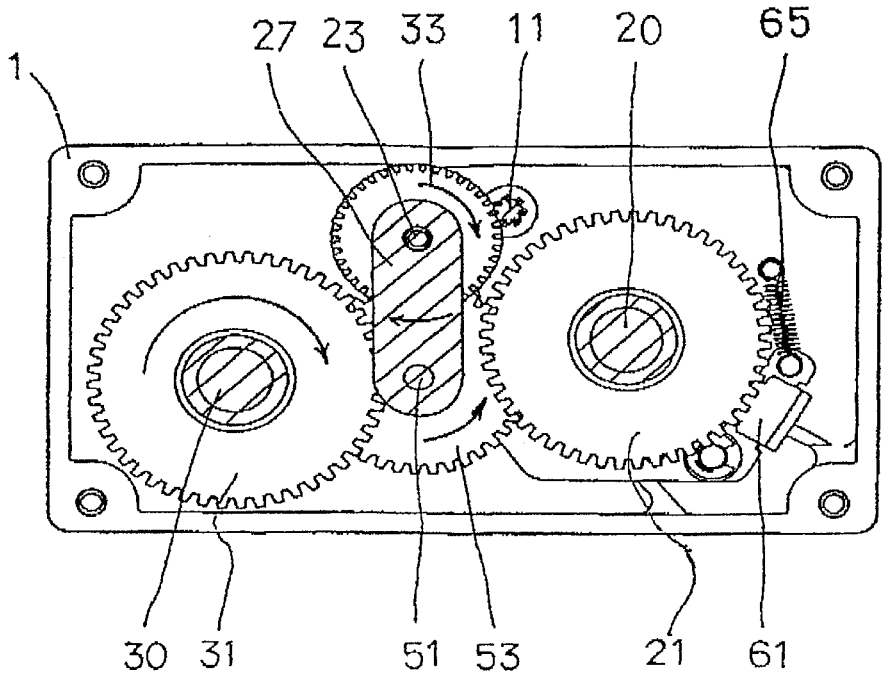

Referring to FIG. 8, a pivotable stop member or link arm 61 rotates about a hinge or support post 63 on the top case member 1. This roughly U-shaped link 61 can act as a stopper or brake for the primary output shaft 20. A spring 65 is arranged so that a portion of the stopper 61 may engage with a primary output gear 21 as shown in FIG. 6. Additionally, the tip of the stopper 61 can freely contact the movable board or link member 25.

Figure 5A:
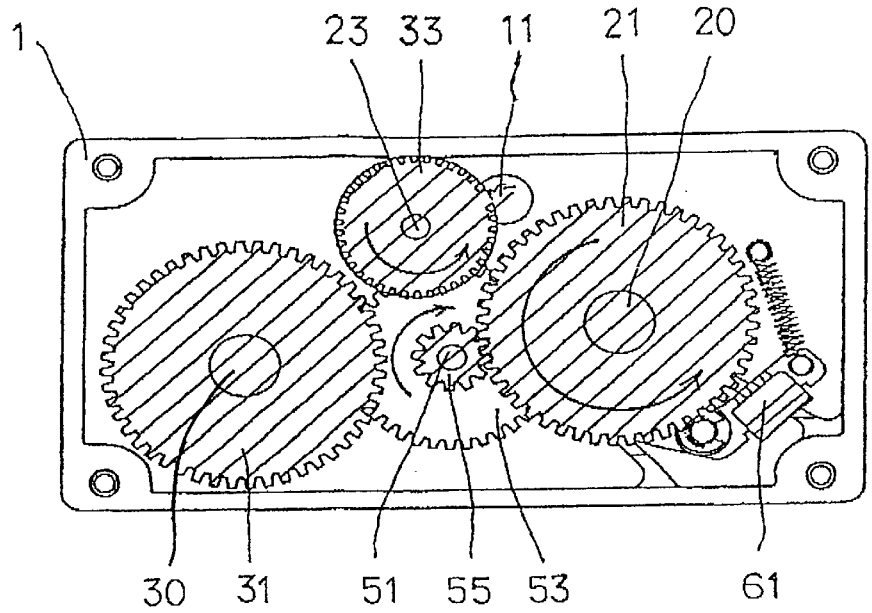
FIGS. 5*a* and 5*b* are respectively cross-sectionals views with certain elements missing on FIG. 4 for explanatory purposes.
Figure 5B:
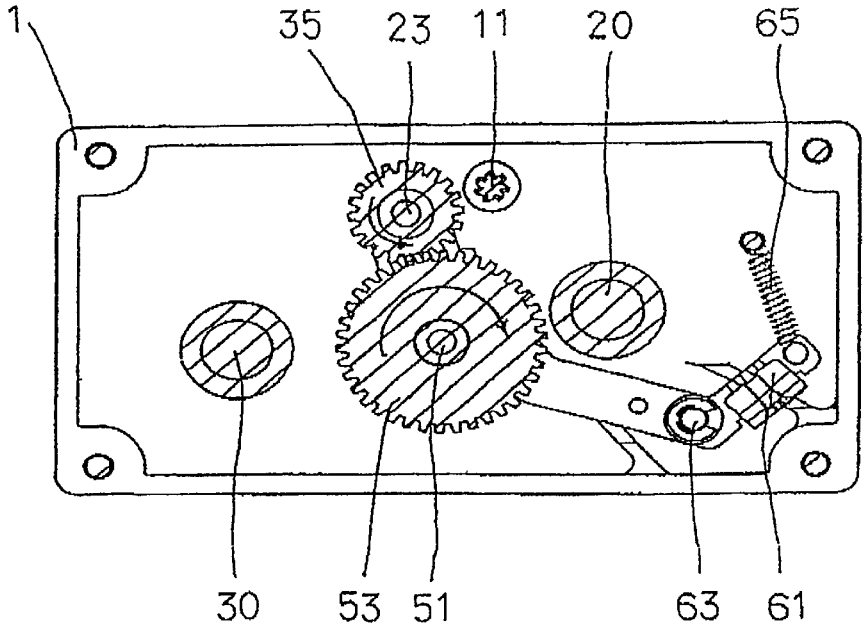
Figure 8A:
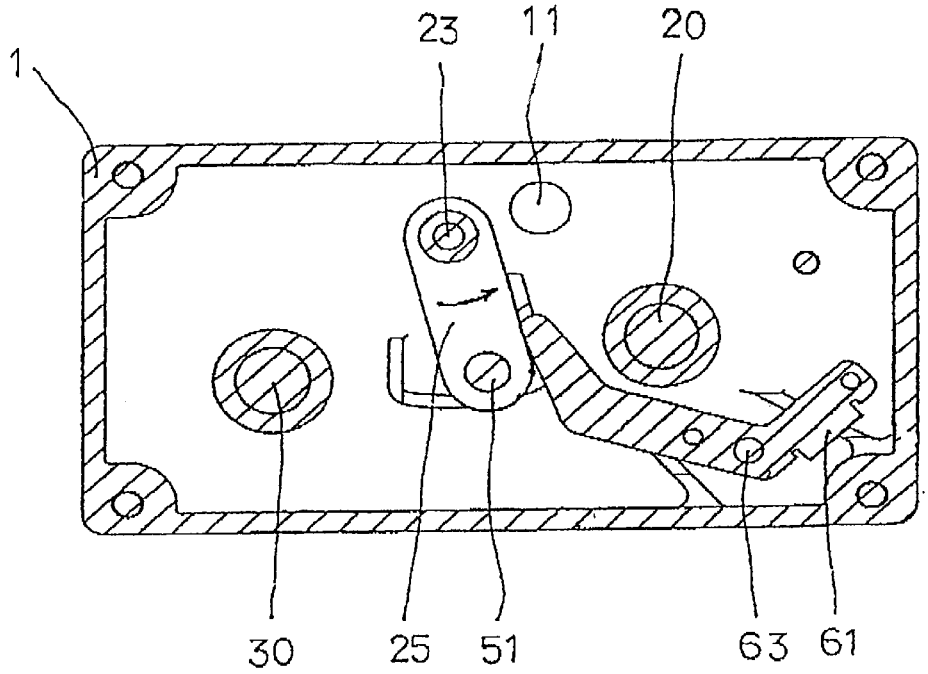
FIGS. 8*a* and 8*b* are explanatory views for disclosing the switching operation of the transmission mechanism.

In operation, the helical gear 33 can be rotated for example in a counter-clockwise direction when the electric motor 10 is rotated in the manner disclosed in FIG. 5*a*. When the helical gear 33 is rotated by the pinion 11 in the counter-clockwise direction, the gear 33 will receive a force along its axial line direction, that is, the helical gear 33 which is rotated by the pinion 11 will receive the thrust so that the helical gear 33 will press the movable board 27 against the plate springs 37. As a result, the movable board 27 will be moved in the counter-clockwise direction receiving a turning force of the helical gear 33 as can be seen in FIG. 4*b*. Thus, when the helical gear 33 is rotated in this manner, the movable boards or link members 25 and 27 are moved in the counter-clockwise direction as a result of the compression of the appropriate set of plate springs 37. The radially outboard transfer shaft 51 is then moved in the counter-clockwise direction so that the spur gear 55 will engage with the primary output gear 21 as can be seen in FIG. 5*a*. In this condition, the counter-clockwise turning force of the helical gear 33 is transmitted to the switching gear 53 as shown in FIG. 5*b*. Then, the turning force of the helical gear 33 is transmitted to the primary output gear 21 through the existing contact with the switching gear 53 and the spur gear 55 as shown in FIG. 5*a*. At this time, the primary output gear 21 can be placed into a free or non-driven condition as the movable board 27 and movable board 25 are moved in the counter-clockwise direction as shown in FIG. 8*a*. That is to say, the stopper 61 can separate from the primary output gear 21.

Figure 7A:
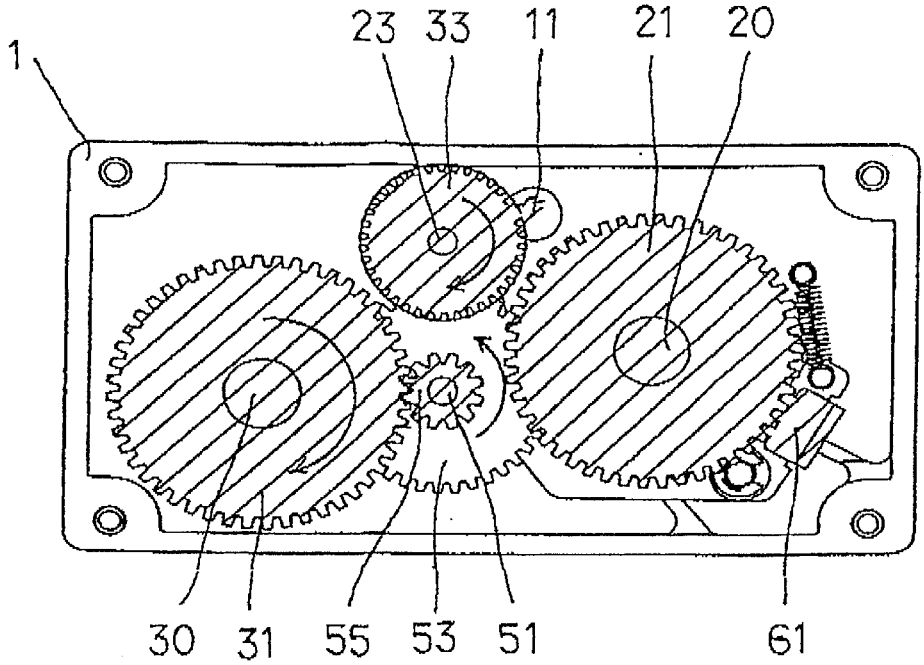
FIGS. 7*a* and 7*b* are respectively cross-sectional views of a portion of FIG. 6 with certain elements omitted for explanatory purposes.
Figure 8B:
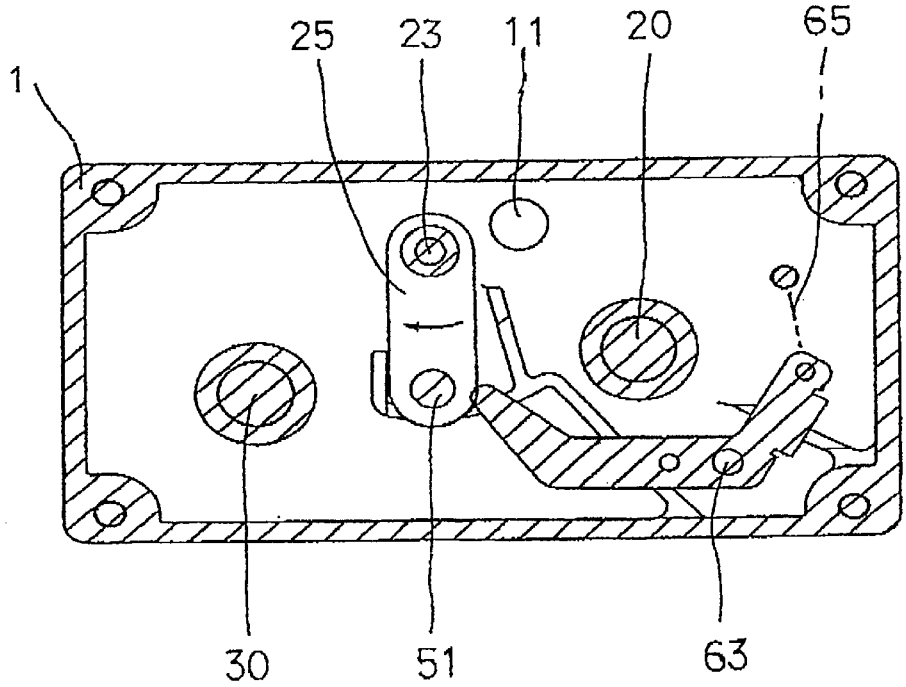
Figure 9:
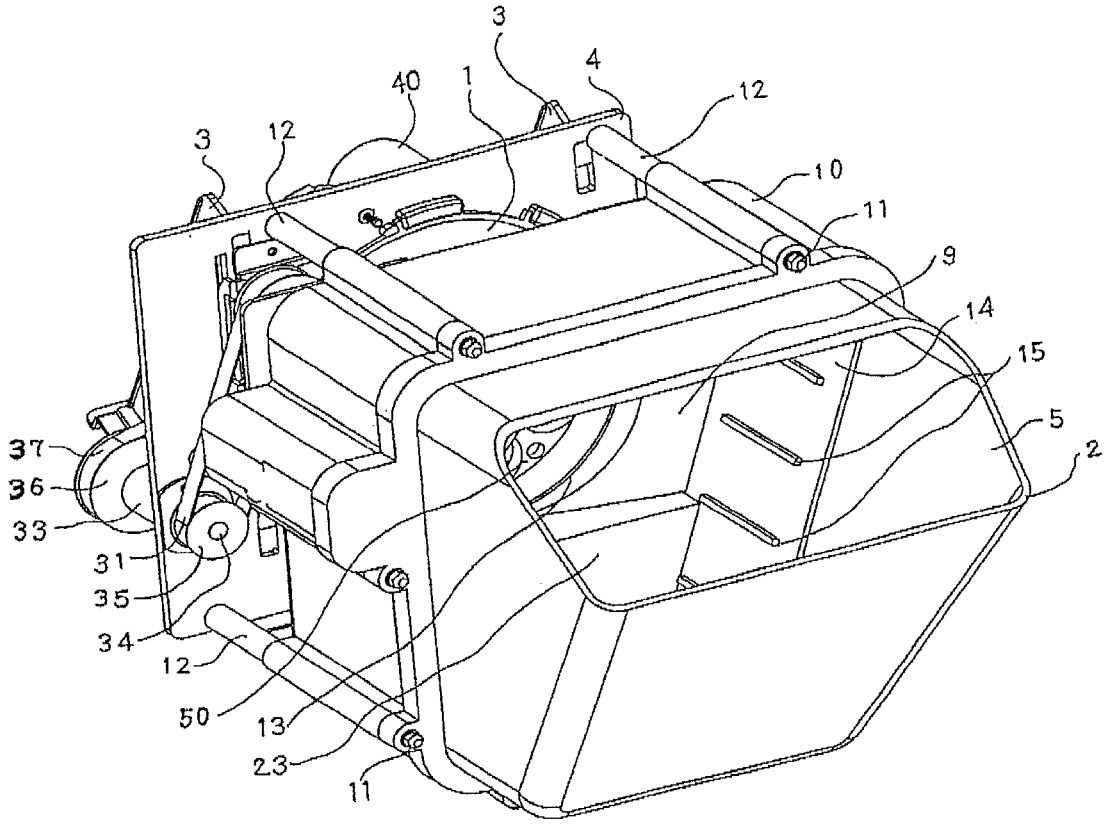
PRIOR ART FIG. 9
FIG. 9 is a perspective view of a conventional coin hopper equipment.
Figure 10:
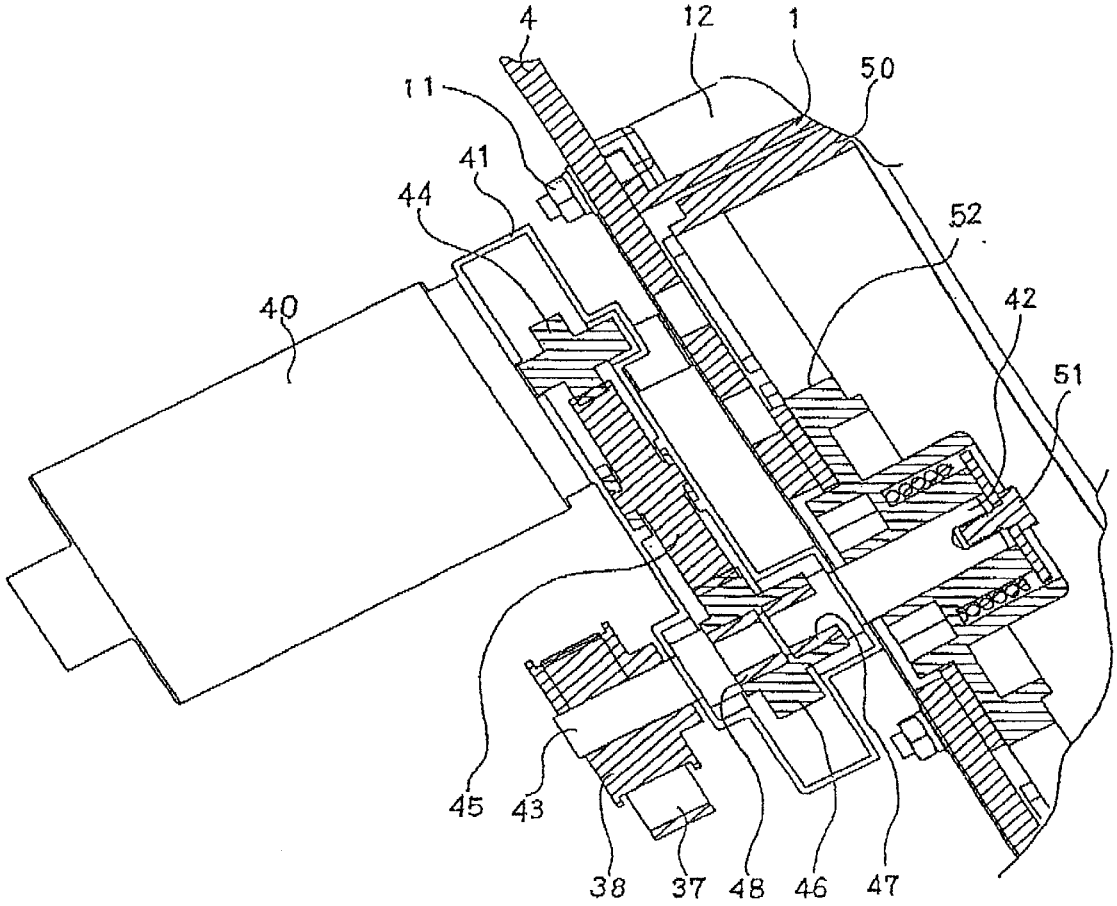
PRIOR ART FIG. 10
FIG. 10 is a cross-sectional view of a portion of FIG. 9.

When the electric motor 10 is reversed, the helical gear 33 is rotated in the clockwise direction, for example, as shown in FIG. 7*a*. When the helical gear 33 is rotated in a clockwise direction by the pinion gear 11, the gear 33 will receive a thrust force along the axial line direction. As a result of this thrust force, the helical gear 33 will press the movable board 25, for example, against the force of the plate spring 37. Upon receiving the thrust or turning force of the helical gear 33, the movable board or link 25 will be moved in the clockwise direction as shown in FIG. 8*b*. Thus, when helical gear 33 is rotated in a clockwise direction, the respective movable boards or link members 25 and 27 are also moved in the clockwise direction against the force of the plate spring 37. As a result, the transfer shaft 51 is also moved in a clockwise direction and the spur gear 55 will engage the second output gear 31 as shown in FIG. 7*a*.

Figure 7B:
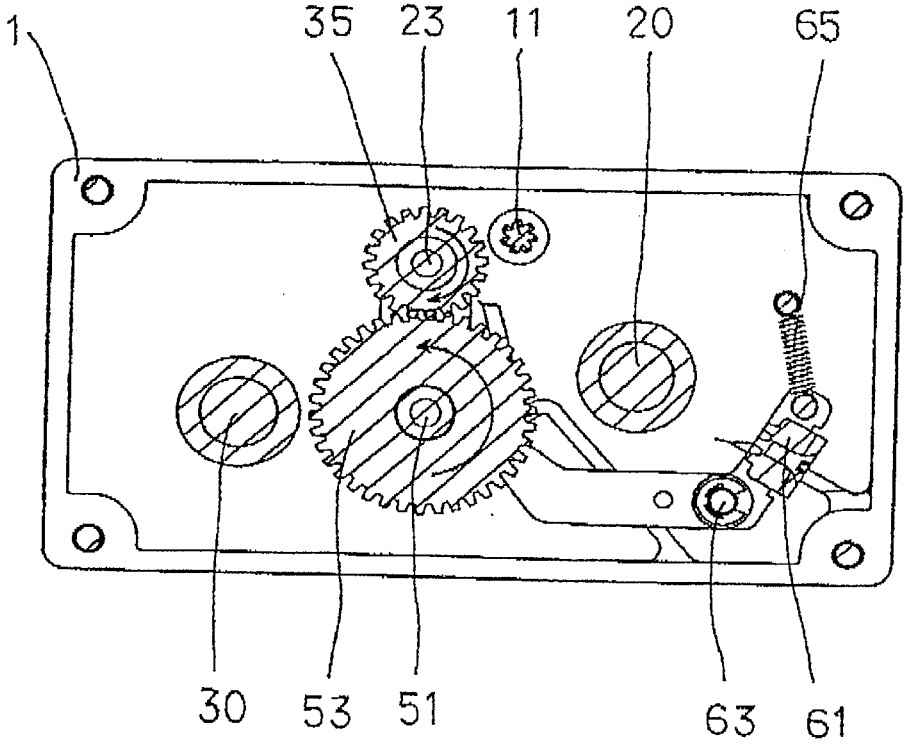

In this condition, the clockwise rotation of the helical gear 33 is transmitted to the switching gear 53 and the existing gear 35 as shown in FIG. 7*b* when the rotation of the helical gear 33 is transmitted to the second output gear 31 through the switching gear 53 and the spur gear 55 as shown in FIG. 7*a*. Additionally, at this time, the stopper 61 becomes in a free condition since the movable board or link member 25 is moved in the clockwise direction as can be seen in FIG. 8*b*. Therefore, as a result of the action of the spring 65, a part of the stopper 61 will mesh with the primary output gear 21 and thereby will act as a braking member to prevent gear 21 from being rotated. See, for example, FIG. 6.

While not shown, a second similar stopper can also mesh freely with the second output gear 31. In this case, the second output gear 31 becomes in a free condition when the movable board or link member 25 is moved in the clockwise direction. Thus, the second stopper can be placed in a free condition when the movable board or link member 25 is moved in the counter-clockwise direction. As a result of a spring (not shown), a part of the second stopper can mesh with the second output gear 31 and thus brake or hold the gear 31 from rotating.

It should be understood that each of the plate springs 37 can also be alternatively provided with a friction material to transmit the thrust of the helical gear 33 to each of the movable board or link members 25 and 27. In the preferred embodiment, each of the plate springs 37 may be of a ring shaped spring and washer member and each of the plate springs 57 between the second step gear and the movable board or link members 25 and 27 can be expressed as a load member which is arranged properly. When the load member such as plate springs 57 are arranged, the thrust of the primary step gear is smoothly transmitted to each of the respective movable boards or link members 25 and 27.

Thus, wherein a load is applied to the second step gear, the thrust of the primary step gear can be smoothly transmitted to the movable boards 25 and 27. As can be appreciated, it is an advantage to permit the plate springs 27 to be made in a ring-type configuration such as a spring and washer or file plate.

In the preferred embodiment, the pinion gear 11 and the gear 33 were designed to be helical. However, it is possible that the pinion gear 11 and the gear 33 may be gears which generate thrust when they are rotated.

In the present invention, the large gear 33 with a helical tooth engaging the small pinion gear 11 with a helical tooth arrangement can be utilized as a driving force. Therefore, the repeated operations of positive rotation, stop and reverse operations and subsequent stopping of the electric motor can be surely transmitted to the output gears 21 and 31 while absorbing any inertia forces that would be imposed on the output gears 21 and 31 as a result of the axial movement and the elastic spring members.

As can be readily appreciated, this relatively simple construction permits an improved performance with a minimum of parts to thereby permit a relatively compact transmission gear assembly for use with a reversible electrical motor. The relative selection or choice of the output shafts can be easily performed by the automatic swing mechanism that is simply activated by the appropriate rotation of the electric motor. The present invention therefore can simply switch the rotating shafts from a hopper disc to a handler belt by a simple switching of the rotational direction of the electric motor.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In a coin storage and dispensing apparatus for storing coins in bulk and having a reversible motor to provide a driving force for transporting coins and dispensing coins with a dispensing member, the improvement comprising:

a transmission assembly connected to a rotational output of the reversible motor having a first support member rotatably mounting a link unit;

a first gear unit mounted adjacent the link unit and operatively connected to the rotational output of the reversible motor wherein the link unit includes a first link member and a second link member, the first gear unit is rotatably mounted on the first support member between the first link member and the second link member;

a mounting unit positioned to operatively connect the first gear unit and to rotate the link unit about the first support member depending on the direction of rotation of the reversible motor wherein the mounting unit includes a first switch member mounted between the first link member and the first gear unit and a second switch member mounted between the second link member and the first gear unit; and a switching gear unit rotatably mounted at an off axis position from the first support member and driven by the out put of the reversible motor whereby the switching gear unit provides a driving force at two separate positions about the first support member depending on the direction of rotation of the reversible motor.

2. The invention of claim 1 wherein the first gear unit is axially movable along the first support member, wherein a clockwise rotational output will move the first gear unit in a first direction and a counter-clockwise rotational output will move the first gear unit in a second direction.

3. The invention of claim 2 wherein the mounting unit includes a first switch member mounted between the first link member and the first gear unit and a second switch member mounted between the second link member and the first gear unit, and the axially movement of the first gear unit will cause the respective first and second switch members to appropriately rotate the switching gear unit.

4. The invention of claim 3 wherein the first and second switch members are resilient members mounted about the first support member.

5. The invention of claim 2 further including a second support member rotatably mounting the switching gear unit and extending between the first link member and the second link member.

6. The invention of claim 5 wherein the first gear unit includes a first helical gear.

7. The invention of claim 6 further including a helical pinion gear providing the rotational output of the reversible motor and intermeshing with the first helical gear.

8. The invention of claim 6 wherein the first gear unit further includes a spur gear intermeshing with the switching gear unit.

9. The invention of claim 6 further including third and fourth switch members mounted about the second support member and extending between the first and second link members.

10. The invention of claim 9 wherein the third and fourth switch members are resilient members of a lesser spring force than the first and second switch members.

11. The invention of claim 6 further including a first output gear for operatively meshing with the switching gear unit at a first position and a second output gear for operatively meshing with the switching gear unit at a second position.

12. The invention of claim 11 further including a stopper unit pivotally mounted in the transmission assembly for braking one of the first and second output gears.

13. The invention of claim 12 wherein the stopper unit is moved by the link unit.

14. In a coin storage and dispensing apparatus for storing coins in bulk and having a reversible motor to provide a driving force for transporting coins and dispensing coins with a dispensing member, the improvement comprising:

a transmission assembly connected to a rotational output of the reversible motor having a first support member rotatably mounting a first link member and a second link member;

a first gear unit mounted between the first link unit and the second link member and operatively connected to the output of the reversible motor, the first gear unit is axially movable along the first shaft;

a mounting unit positioned to connect the first gear unit and to respectively rotate the first and second link member about the first shaft depending upon the direction of rotation of the reversible motor; and a switching gear unit rotatably mounted at an off axis position from the first shaft between the first and second link members and driven by the output of the reversible motor whereby the switching gear unit can operatively provide a driving force in at least two separate positions for providing output power depending upon the direction of rotation of the reversible motor, wherein the mounting unit includes a first switch member mounted between the first link member and the first gear unit and a second switch member mounted between the second link member and the first gear unit, and the axially movement of the first gear unit will cause the respective first and second switch members to appropriately rotate the switching gear unit.

15. The invention of claim 14 wherein the first and second switch members are resilient members mounted about the first support member.

16. The invention of claim 14 further including a second support member rotatably mounting the switching gear unit and extending between the first link member and the second link member.

17. The invention of claim 14 further including third and fourth switch members mounted about the second support member and extending between the first and second link members.

18. A transmission gear assembly for selecting one of a plurality of output shafts, comprising:

an input drive shaft with a pinion gear;

a fixed support shaft;

a primary stepped gear unit rotatably mounted on the fixed support shaft having a helical gear meshing with the pinion gear and a first spur gear;

a pair of movable board members which are rotatably mounted respectively on the fixed support shaft to sandwich the primary stepped gear unit;

a transfer shaft which is fixed between the movable board members;

a second stepped gear unit which is rotatably mounted on the transfer shaft having a switching gear meshing with the first spur gear and a second spur gear; and an output shaft gear operatively connected to an output shaft for meshing with the second spur gear.

19. A transmission gear assembly as in claim 18 further including a friction bearing unit provided between the pair of movable board members and the primary stepped gear.

20. A transmission gear assembly as in claim 19 wherein the friction bearing unit includes an elastic member.

21. In a coin storage and dispensing apparatus for storing coins in bulk and having a reversible motor to provide a driving force for transporting coins and dispensing coins with a dispensing member, the improvement comprising:

a transmission assembly connected to a rotational output of the reversible motor having a first support member rotatably mounting a link unit;

a first gear unit mounted adjacent the link unit and operatively connected to the rotational output of the reversible motor;

a mounting unit positioned to operatively contact the first gear unit and to rotate the link unit about the first support member depending on the direction of rotation of the reversible motor;

a switching gear unit rotatably mounted at an off axis position from the first support member and driven by the output of the reversible motor whereby the switching gear unit provides a driving force at two separate positions about the first support member depending on the direction of rotation of the reversible motor; and a stopper unit biased to a first position and released from the first position by movement of the link unit.

22. The invention of claim 21 wherein the stopper unit is pivotally mounted in the transmission assembly and is cammed by the link unit to a release position.

23. The invention of claim 21 further including a first output gear for operatively meshing with the switching gear unit at a first position and a second output gear for operatively meshing with the switching gear unit at a second position, the stopper unit is pivotally mounted in the transmission assembly for braking one of the first and second output gears.

24. A transmission gear assembly for selecting one of a plurality of output shafts, comprising:

an input drive shaft with an input gear;

a fixed support shaft;

a primary stepped gear unit rotatably mounted on the fixed support shaft having a first gear meshing with the input gear and a first spur gear;

a pair of movable board members which are rotatably mounted respectively on the fixed support shaft to sandwich the primary stepped gear unit;

a transfer shaft which is fixed between the movable board members;

a second gear unit which is rotatably mounted on the transfer shaft having a switching gear meshing with the first spur gear, and an output shaft gear operatively connected to an output shaft for meshing with the second gear unit.

25. The transmission gear assembly of claim 24, further including a stopper unit biased to a first position and released from the first position by a camming contact with one of the pair of movable board members.

* * * * *